US011649659B2

(12) United States Patent
Chen et al.

(10) Patent No.: US 11,649,659 B2
(45) Date of Patent: May 16, 2023

(54) MECHANISM FOR OPENING A VEHICLE DOOR

(71) Applicant: Illinois Tool Works Inc., Glenview, IL (US)

(72) Inventors: Bin Chen, Shanghai (CN); Wenquan Sha, Shanghai (CN)

(73) Assignee: Illinois Tool Works Inc., Glenview, IL (US)

( * ) Notice: Subject to any disclaimer, the term of this patent is extended or adjusted under 35 U.S.C. 154(b) by 218 days.

(21) Appl. No.: 16/771,536

(22) PCT Filed: Dec. 21, 2018

(86) PCT No.: PCT/US2018/067285
§ 371 (c)(1),
(2) Date: Jun. 10, 2020

(87) PCT Pub. No.: WO2019/133527
PCT Pub. Date: Jul. 4, 2019

(65) Prior Publication Data

US 2021/0172209 A1 Jun. 10, 2021

(30) Foreign Application Priority Data

Dec. 27, 2017 (CN) ..... 201711447689.2

(51) Int. Cl.
*E05B 79/22* (2014.01)
*E05B 85/10* (2014.01)
*E05B 79/06* (2014.01)

(52) U.S. Cl.
CPC ..... *E05B 79/22* (2013.01); *E05B 85/103* (2013.01); *E05B 79/06* (2013.01); *E05Y 2900/531* (2013.01)

(58) Field of Classification Search
CPC ..... E05B 79/22; E05B 85/103; E05B 79/06; E05B 85/14; E05B 85/10; E05Y 2900/531
(Continued)

(56) References Cited

U.S. PATENT DOCUMENTS 5,560,659 A * 10/1996 Dault ..... E05B 77/06 292/336.3
7,108,301 B2 * 9/2006 Louvel ..... E05B 81/78 292/201
(Continued)

FOREIGN PATENT DOCUMENTS

CH 191794 A 7/1937
CN 104066911 A 9/2014
(Continued)

OTHER PUBLICATIONS

International Search Report and Written Opinion for PCT/US2018/067285, dated Apr. 11, 2019. (13 pages).
(Continued)

*Primary Examiner* — Kristina R Fulton
*Assistant Examiner* — Thomas L Neubauer
(74) *Attorney, Agent, or Firm* — Quarles & Brady LLP

(57) ABSTRACT

A mechanism for opening a vehicle door, comprising: a door opening component for opening the vehicle door, a cover plate, and a first fixed rotational axle. The door opening component is disposed in an operating cavity. The cover plate covers the operating cavity such that the cover plate is concealed in the door. The first fixed rotational axle is mounted adjacent to the operating cavity. A side edge of the cover plate is mounted on the first fixed rotational axle such that when an external force is applied to the cover plate, the cover plate is rotatable about the first fixed rotational axle to enter the operating cavity such that the door opening com-
(Continued)

ponent is accessible to an operator via the operating cavity to open the vehicle door.

20 Claims, 10 Drawing Sheets

(58) Field of Classification Search
USPC ..... 292/336.3
See application file for complete search history.

(56) References Cited

U.S. PATENT DOCUMENTS

| | | | | |
|---|---|---|---|---|
| 9,518,410 | B2 * | 12/2016 | Vasi | E05B 81/08 |
| 9,724,985 | B2 * | 8/2017 | Leve | E05B 5/00 |
| 2013/0170241 | A1 * | 7/2013 | Lesueur | E05B 77/42 70/91 |

FOREIGN PATENT DOCUMENTS

| | | | |
|---|---|---|---|
| DE | 4239166 | A1 | 5/1994 |
| DE | 202004015576 | U1 | 5/2005 |
| EP | 0893561 | A1 | 1/1999 |
| FR | 2886664 | A1 | 12/2006 |
| JP | H03221681 | A | 9/1991 |

OTHER PUBLICATIONS

First Office Action from corresponding Chinese Patent Application No. 201711447689.2, dated Apr. 2, 2021 (8 pages) (English translation included).

Search Report, related Chinese Application No. 201711447689.2, dated Mar. 29, 2021, (2 pages).

* cited by examiner

MECHANISM FOR OPENING A VEHICLE DOOR

CROSS REFERENCE TO RELATED APPLICATIONS

The present application represents the United States National Stage of International Application No. PCT/US2018/067285, filed Dec. 21, 2018, which claims priority to, Chinese patent application number 201711447689.2, filed Dec. 27, 2017, the entire contents of which are incorporated by reference in their entirety.

FIELD OF THE INVENTION

The present application relates to a mechanism for opening a vehicle door, in particular to a mechanism for opening a vehicle door for use in a concealed vehicle door.

BACKGROUND

An operating mechanism for opening a vehicle door, for example, a handle, is provided on the sheet metal of the vehicle door. In a conventional design, the handle is generally disposed to protrude beyond the sheet metal plane of the vehicle door to facilitate operations. However, a handle that protrudes beyond the sheet metal plane of the vehicle door occupies a large space and is susceptible to scraping and accumulating dust, and also increases the wind resistance of the vehicle during travel. The present application seeks to provide a concealed operating mechanism for opening a vehicle door such that its outer surface is flush with or slightly below the sheet metal plane of the vehicle door.

SUMMARY OF THE INVENTION

In order to overcome the above problems, the present application provides a concealed mechanism for opening a vehicle door, the mechanism for opening a vehicle door comprising: an operating cavity, the operating cavity housing a component for opening the vehicle door; a cover plate, the cover plate covering the operating cavity such that the cover plate is concealed in the sheet metal of the vehicle door; and a first fixed rotational axle, the first fixed rotational axle being mounted near an opening of the operating cavity or in the operating cavity, one side edge of the cover plate being mounted on the first fixed rotational axle such that when an external force is applied to the cover plate, the cover plate is rotatable about the first fixed rotational axle to enter the operating cavity so that an operator's hand can extend into the operating cavity to operate a component in the operating cavity for opening the vehicle door.

The mechanism for opening a vehicle door as described above further comprises: a transmission mechanism, housed in the operating cavity and driven by rotation of the cover plate; when the cover plate rotates inside the operating cavity about the first fixed rotational axle by more than a predetermined angle, the cover plate drives the transmission mechanism such that the transmission mechanism actuates a component for opening the vehicle door.

In the mechanism for opening a vehicle door as described above, the transmission mechanism comprises a connecting rod, the connecting rod comprising a first rod, a second rod, and a third rod, the first rod is connected to the cover plate and rotatable about the first fixed rotational axle; the second rod is connected to the first rod by a first moving axle, and the third rod and the second rod are connected by a second moving axle; the mechanism for opening a vehicle door further comprises an actuator, the actuator is mounted on a second fixed rotational axle and is rotatable about the second fixed rotational axle, and the actuator is connected to the third rod such that the transmission mechanism causes the actuator to actuate a component for opening the vehicle door.

The mechanism for opening a vehicle door as described above comprises a connecting rod limiter, and the connecting rod limiter is capable of limiting a range of movement of the second moving axle.

In the mechanism for opening a vehicle door as described above, the connecting rod limiter comprises a limiting plate, the limiting plate is provided with a limiting slot, and the second moving axle is inserted in the limiting slot.

The mechanism for opening a vehicle door as described above is characterized in that it further comprises: an operating component, the operating component being mounted on the second fixed rotational axle and rotatable about the second fixed rotational axle; the operating component comprises a handle operating portion and an actuator; when an operator applies a force to the handle operating portion, the operating component is rotatable such that the actuator actuates a component for opening the vehicle door.

In the mechanism for opening a vehicle door as described above, the operating component is an L-shaped plate, the L-shaped plate comprises a first plate and a second plate that is connected to the first plate, the first plate comprises a handle operating portion, the second plate comprises an actuator, and the second fixed rotational axle is mounted at a junction of the first plate and the second plate such that the L-shaped plate is rotatable about the second fixed rotational axle.

In the mechanism for opening a vehicle door as described above, the component for opening a vehicle door further comprises: a rocker arm, the rocker arm being mounted on a third fixed rotational axle and rotatable about the third fixed rotational axle; the rocker arm comprises an actuated portion and an execution portion, and the actuator of the operating component drives the actuated portion of the rocker arm such that the rocker arm rotates about the third fixed rotational axle, thereby enabling the execution portion of the rocker arm to open a vehicle door lock.

In the mechanism for opening a vehicle door as described above, the first fixed rotational axle comprises two sections of first fixed rotational axle, and the two sections of first fixed rotational axle are connected to one side of the cover plate.

In the mechanism for opening a vehicle door as described above, the mechanism for opening a vehicle door further comprises a cover plate resetter, the cover plate resetter being for resetting the cover plate.

With the mechanism for opening a vehicle door according to the present invention, the surface of the vehicle door is flat, and not prone to scraping or accumulating dust; in addition, the wind resistance of the vehicle during travel is reduced, and the appearance of the vehicle is uniform and esthetically pleasing. The mechanism for opening a vehicle door according to the present invention has a simple structure and a low cost, and is easy to manufacture and repair; is not prone to damage, and has a long service life.

BRIEF DESCRIPTION OF THE DRAWINGS

These and other features and advantages of the present invention will be better understood from the following detailed description in conjunction with the attached drawings. In the drawings, the same reference numerals are used for the same components, wherein.

SPECIFIC EMBODIMENTS

Figure 1A:
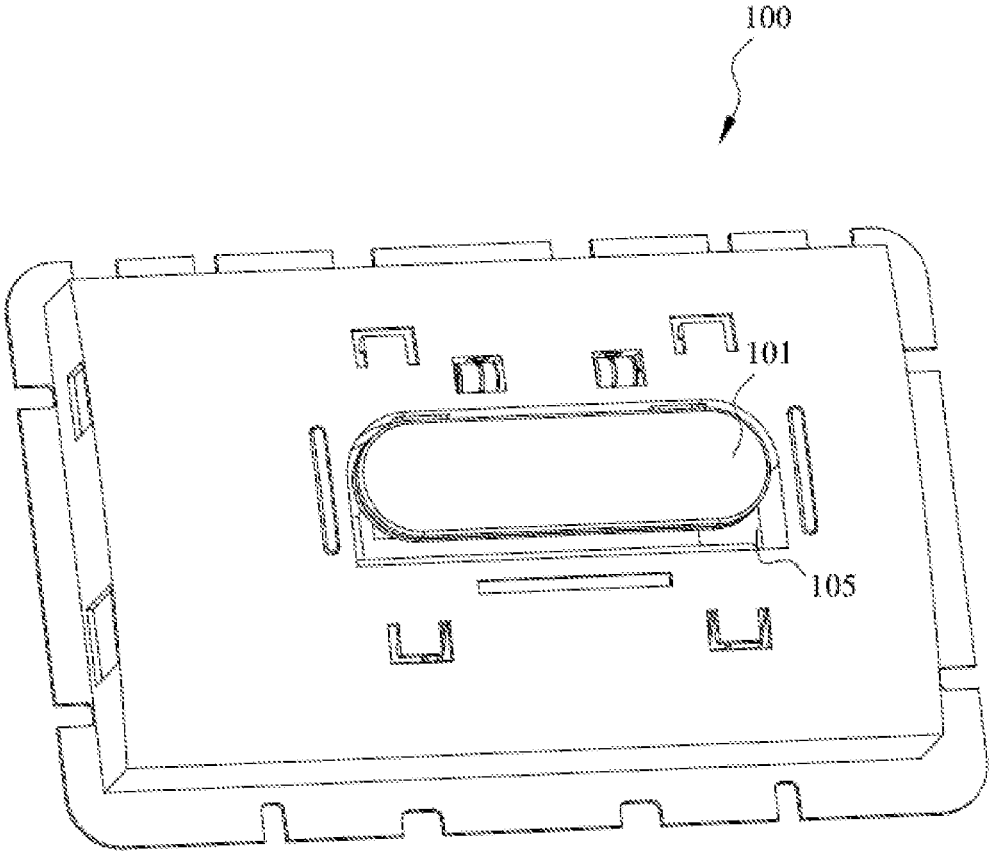
FIG. 1A is a perspective view of an embodiment of a mechanism for opening a vehicle door according to the present invention.

Various specific embodiments of the present invention are described below with reference to the drawings which form a part of this specification. It should be understood that although terms referring to directions, such as "front", "back", "upper", "lower", "left", "right", "top", "bottom", etc. are used to describe or illustrate the various example structural components and elements according to the present invention, these terms are used herein for purposes of illustration only, and are based on the example orientation shown in the figures. Since the disclosed embodiments can be arranged in different orientations, these terms are merely illustrative and should not be taken as limiting. In the following drawings, the same reference numerals are used for the same components, and similar components are given similar reference numerals, thereby avoiding any repeated description.

Figure 1B:
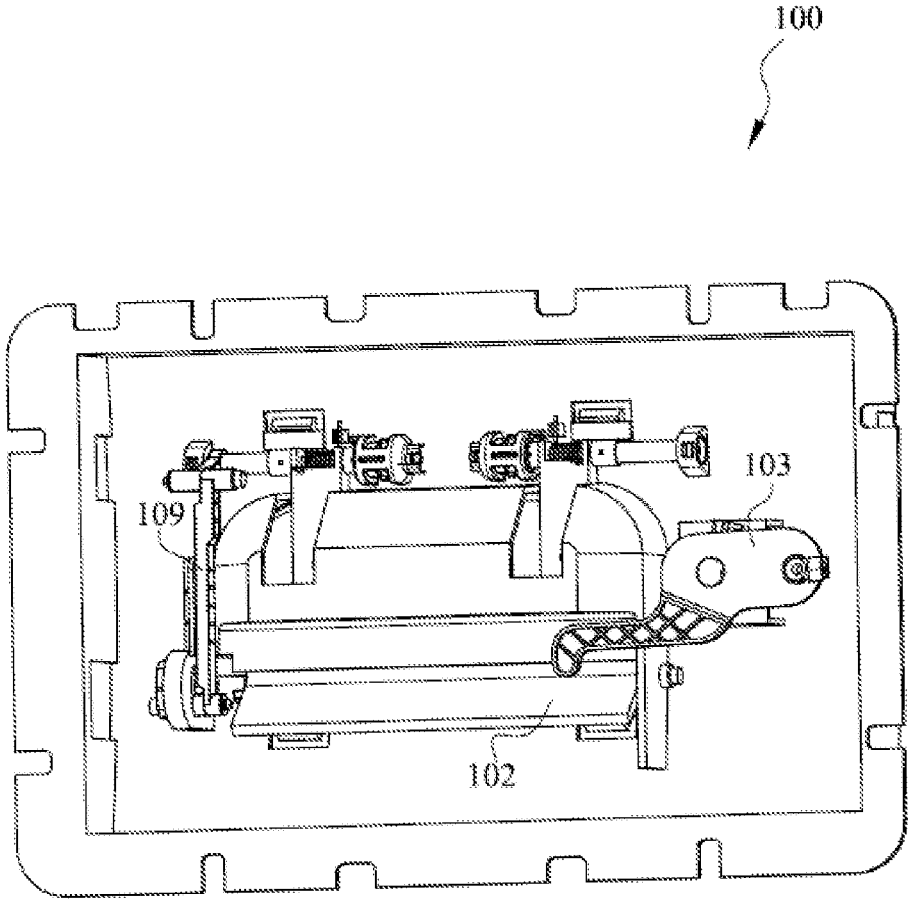
FIG. 1B is a perspective view of another angle of the mechanism for opening a vehicle door according to the present invention shown in FIG. 1A.
Figure 1C:
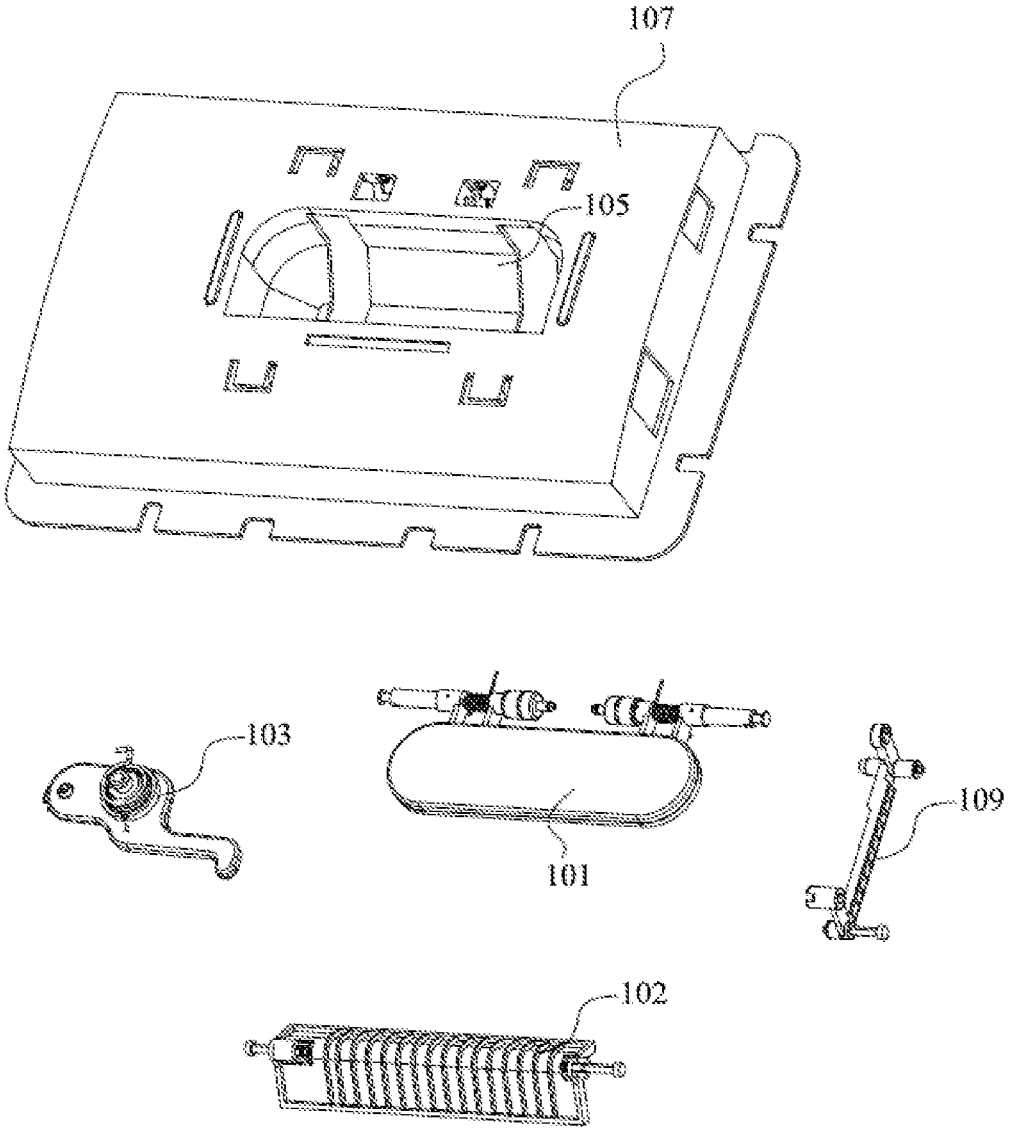
FIG. 1C is an exploded view of the mechanism for opening a vehicle door according to the present invention shown in FIG. 1A.

FIGS. 1A and 1B are respectively perspective structural diagrams showing a front view and a rear view of an embodiment of a mechanism for opening a door according to the present invention, and FIG. 1C is an exploded view of the mechanism for opening a vehicle door shown in FIGS. 1A and 1B. As shown in FIGS. 1A, 1B, and 1C, the mechanism 100 for opening a vehicle door comprises a housing 107, a cover plate 101, a rocker arm 103, an operating component 102, and a connecting rod 109. An operating cavity 105 is disposed on the front side of the housing 107, and the cover plate 101 covers the operating cavity 105. The rocker arm 103, the operating component 102, and the connecting rod 109 are disposed on the rear side of the housing 107. During use, after the mechanism 100 for opening a vehicle door is mounted in a corresponding position on the vehicle door, an operator can push the cover plate 101 into the operating cavity 105. Then, the operator's hand can extend into the operating cavity 105 to operate a component for opening the vehicle door, thereby opening the door. The process of opening the vehicle door will be described in detail below. On a corresponding door, the cover plate 101 is flush with the sheet metal plane of the door or not higher than the sheet metal plane of the door, so that the mechanism 100 for opening a vehicle door is concealed in the door, and the surface of the door is smooth and streamlined.

Figure 2A:
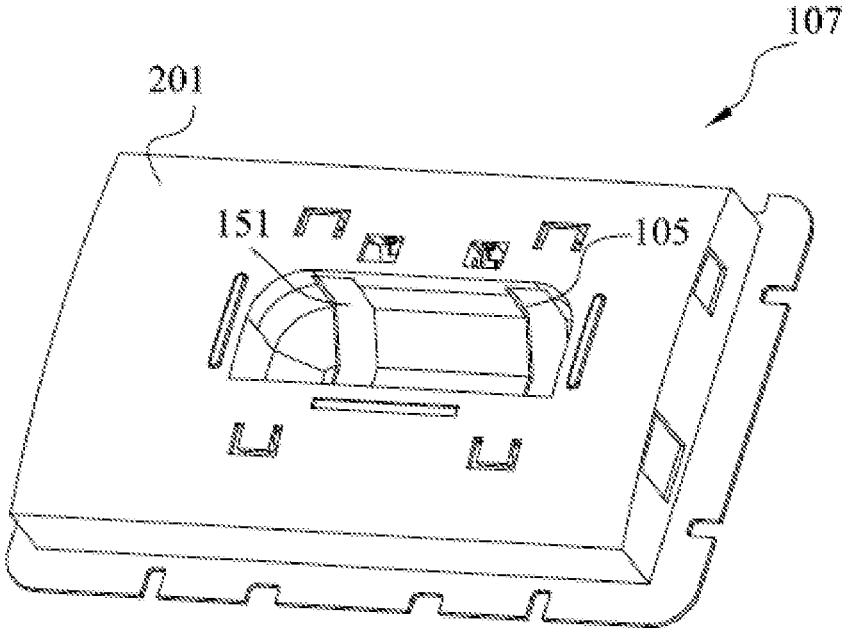
FIG. 2A is a perspective view of the housing shown in FIG. 1A.
Figure 2B:
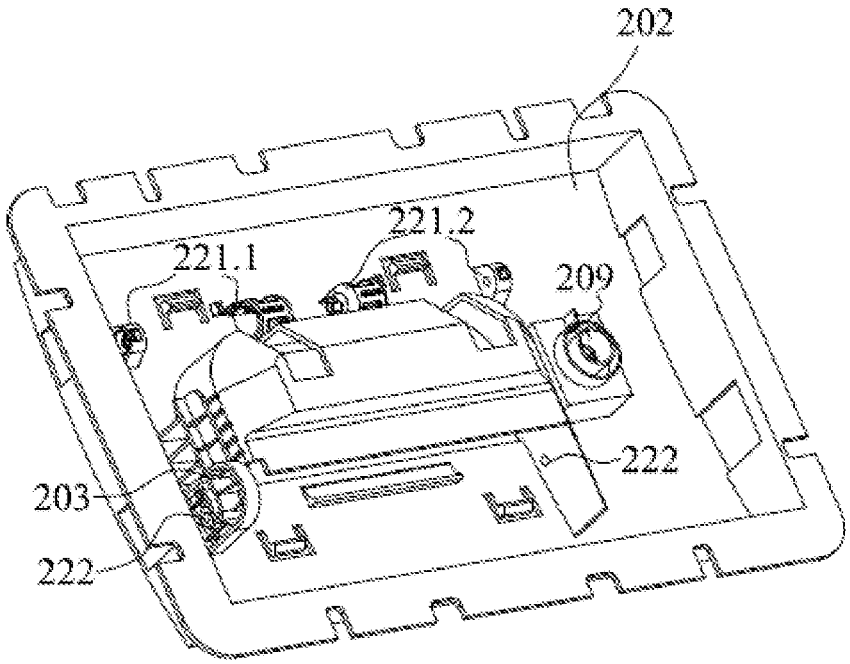
FIG. 2B is a perspective view of another angle of the housing shown in FIG. 2A.

FIGS. 2A and 2B are schematic perspective views showing two different angles of the housing 107 of the mechanism 100 for opening a vehicle door in FIG. 1A. As shown in FIGS. 2A and 2B, the housing 107 is provided with a front side 201 and a rear side 202. During use, the front side 201 faces the outside of the door, the rear side 202 faces the interior of the vehicle. Between the front side 201 and the door mounting location, a gasket may be provided for reinforcing the seal between the housing 107 and the door. The operating cavity 105 is recessed toward the interior from the front side 201. The operating cavity 105 is provided with an opening 151, and the cover plate 101 can cover the opening 151. The rear side 202 of the housing 107 is provided with first axle brackets 221.1, 221.2 for mounting first fixed rotational axles 301.1, 301.2 (shown in FIG. 3), a second axle bracket 222 for mounting a second fixed rotational axle 407 (shown in FIG. 4), a third axle bracket 209 for mounting a third fixed rotational axle 509 (shown in FIG. 5), and a limiter 203 for limiting the movement range of a second moving axle 605 (shown in FIG. 6A). These components will be described in detail below.

Figure 3:
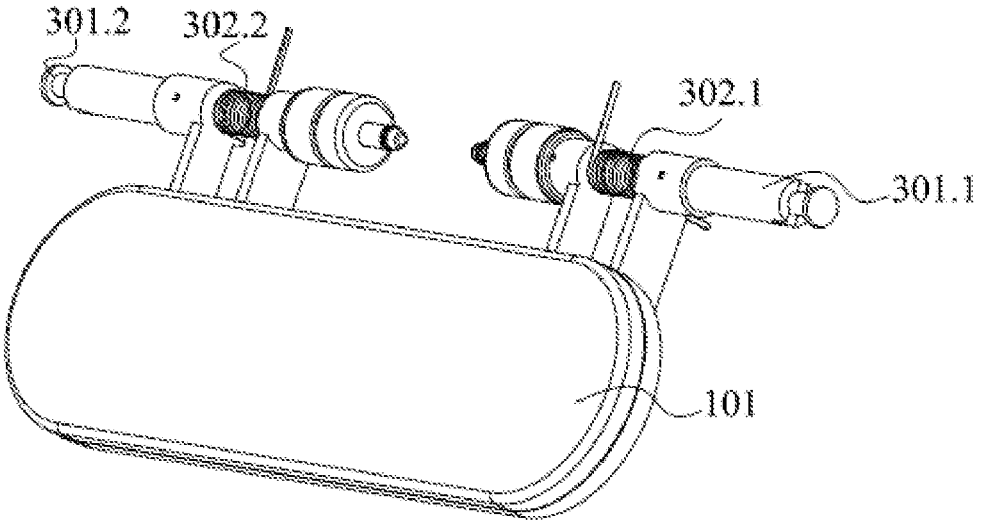
FIG. 3 is a perspective view of the cover plate assembly shown in FIG. 1A.

FIG. 3 shows a perspective structural view of the cover plate 101 of the mechanism 100 for opening a vehicle door shown in FIG. 1A and its associated components. As shown in FIG. 3, one side edge 110 (see FIG. 6A) of the cover plate 101 is mounted on the first fixed rotational axles 301.1, 301.2, and is fixedly connected with the first fixed rotational axles 301.1, 301.2, so that the cover plate 101 rotates with the rotation of the first fixed rotational axles 301.1, 301.2. The first fixed rotational axles 301.1, 301.2 are mounted on the first axle brackets 221.1, 221.2 of the housing 107 and are rotatable relative to the first axle brackets 221.1, 221.2. When an external force is applied to the cover plate 101, the cover plate 101 drives the first fixed rotational axles 301.1, 301.2 to rotate relative to the first axle brackets 221.1, 221.2, so that the cover plate 101 can enter the operating cavity 105. In the present embodiment, the first fixed rotational axles 301.1, 301.2 are two separate sections, comprising a first section 301.1 and a second section 301.2, and the first section 301.1 and the second section 302.2 are coaxially disposed. In another embodiment, the first fixed rotational axle can be one section.

A cover plate resetter is disposed between the cover plate 101 and the housing 107 such that the cover plate 101 is held in an initial position parallel or substantially parallel to the surface of the front side 201 of the housing 107 when subjected to an external force. When the cover plate 101 is pushed inward, the force provided by the cover plate resetter needs to be overcome. In one embodiment, the cover plate resetter is a pair of torsion springs 302.1, 302.2, and each of the pair of torsion springs 302.1, 302.2 is respectively sheathed on the first section 301.1 of first fixed rotational axle and the second section 301.2 of first fixed rotational axle. When the cover plate 101 is mounted on the housing 107, the pair of torsion springs 302.1, 302.2 remains in a compressed state.

Figure 4:
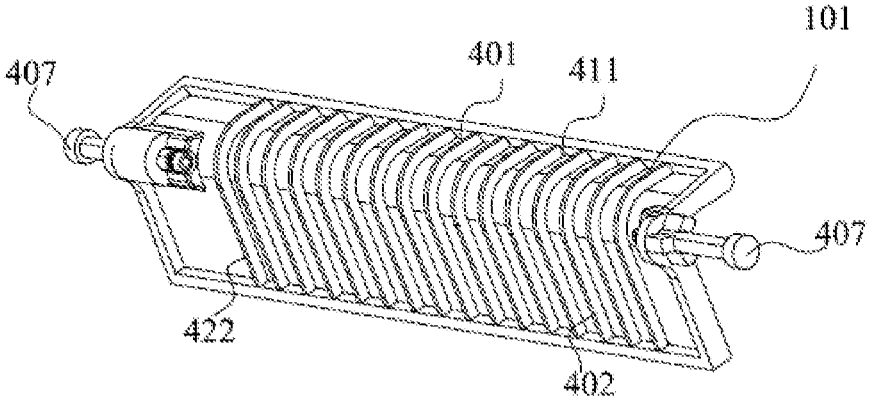
FIG. 4 is a perspective view of the operating component assembly shown in FIG. 1A.

FIG. 4 is a schematic perspective view showing the operating component 102 and the second fixed rotational axle 407 shown in FIG. 1A. As shown in FIG. 4, the operating component 102 comprises a first plate 401 and a second plate 402, and the first plate 401 and the second plate 402 are connected to each other to form an included angle such that the operating component 102 is substantially L-shaped. A second fixed rotational axle 407 may be disposed at a joint of the first plate 401 and the second plate 402. The second fixed rotational axle 407 is mounted on the second axle bracket 222 of the housing 107. The operating component 102 is rotatable relative to the housing 107 about the second fixed rotational axle 407. A handle operating portion 411 is formed on the first plate 401, and an actuator 422 is formed on the second plate 402.

Figure 5:
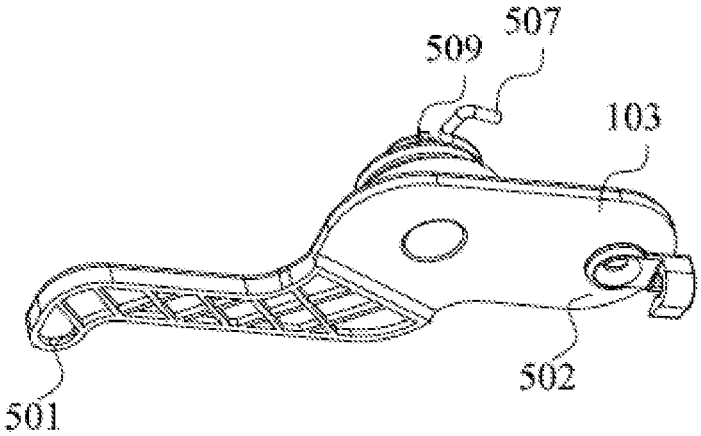
FIG. 5 is a perspective view of the rocker arm assembly shown in FIG. 1A.

FIG. 5 is a perspective view showing the rocker arm 103 of FIG. 1A and its components. As shown in FIG. 5, the rocker arm 103 is provided with a third fixed rotational axle 509, and the third fixed rotational axle 509 is mounted on the third axle bracket 209 of the housing 107, so that the third fixed rotational axle 509 can rotate relative to the third axle bracket 209, allowing the rocker arm 103 to rotate relative to the housing 107 about the third fixed rotational axle 509. The rocker arm 103 comprises an actuated portion 501 and an execution portion 502; the execution portion 502 is connected to a bolt (not shown); the actuated portion 501 is driven by the actuator 422 of the operating component 102 such that the rocker arm 103 rotates about the third fixed rotational axle 509; thus, the execution portion 502 of the rocker arm 103 pulls the bolt to open a door lock. After the door lock is opened, an operator can open the door. The rocker arm 103 is provided with a rocker arm resetter for holding the actuated portion 501 of the rocker arm 103 against the actuator 422 of the operating component 102. The rocker arm resetter is a torsion spring 507, and the torsion spring 507 is disposed on the third fixed rotational axle 509.

Figure 6A:
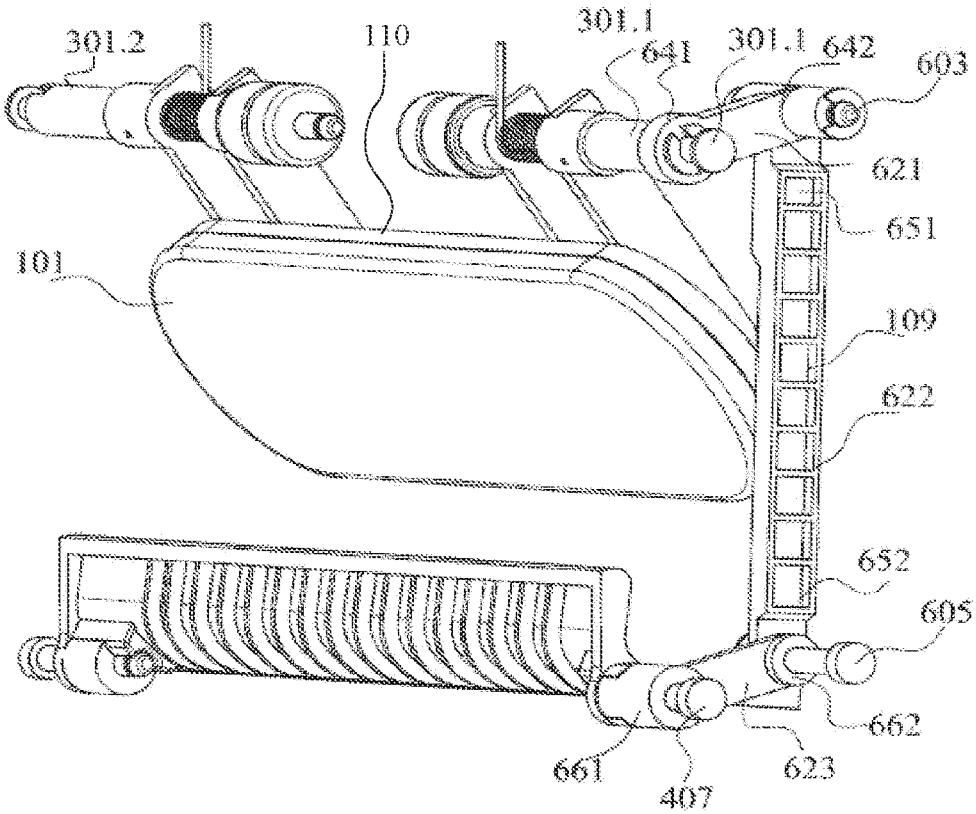
FIG. 6A is a schematic view showing the combination of the cover plate, the connecting rod and the operating component shown in FIG. 1A.

FIG. 6A is a perspective structural view showing the connecting rod, as well as the fitting relationship among the cover plate, the connecting rod, and the operating component in FIG. 1A. The connecting rod 109 forms a transmission mechanism that can transmit the rotation of the cover plate 101 to actuate the component for opening the door. Specifically, as shown in FIG. 6A, the cover plate 101 is connected to the operating component 102 via the connecting rod 109, so that the cover plate 101 can drive the operating component 102 to rotate by the connecting rod 109. The connecting rod 109 comprises a first rod 621, a second rod 622, and a third rod 623. The first rod 621 is fixedly connected to the cover plate 101 and can rotate about the first fixed rotational axles 301.1, 301.2 along with the cover plate 101. The first fixed rotational axles 301.1, 301.2 are close to a first end 641 of the first rod. A first end 651 of the second rod 622 is connected to a second end 642 of the first rod 621 by a first moving axle 603, and the second rod 622 and the first rod 621 are both rotatable about the first moving axle 603; in addition, the first moving axle 603 can rotate about the first fixed rotational axle 301.1 within a certain range, thereby enabling the first moving axle 603 to move relative to the housing 107. Similarly, a second end 662 of the third rod 623 and a second end 652 of the second rod 622 are connected by a second moving axle 605, so that the third rod 623 and the second rod 622 can both rotate about the second moving axle 605; in addition, the second moving axle 605 can rotate about the second fixed rotational axle 407 within a certain range, thereby enabling the second moving axle 605 to move relative to the housing 107. The second fixed rotational axle 407 is close to the second end 661 of the third rod, and the third rod 623 is fixedly connected relative to the operating component 102. When the third rod 623 is driven by the second rod 622 to rotate about the second fixed rotational axle 407, the operating component 102 rotates together with the third rod 623.

It should be noted that the first rod 621 of the connecting rod 109 and the cover plate 101 can be directly fixedly connected, or the first rod 621 of the connecting rod 109 and the cover plate 101 are respectively fixed with the first fixed rotational axles 301.1, 301.2 so that they are fixedly connected to each other. Therefore, the rotation of the cover plate 101 can drive the rotation of the first rod 621. Further, the third rod 623 of the connecting rod 109 and the operating component 102 may be directly fixedly connected, or the third rod 623 of the connecting rod 109 and the operating component 102 may be fixedly connected to the second fixed rotational axle 407, respectively, so that they are fixedly connected to each other. Thus, the rotation of the third rod 623 of the connecting rod 109 can drive the rotation of the operating component 102 such that the connecting rod 109 can drive the operating component 102 to actuate the component for opening the door.

Figure 6D:
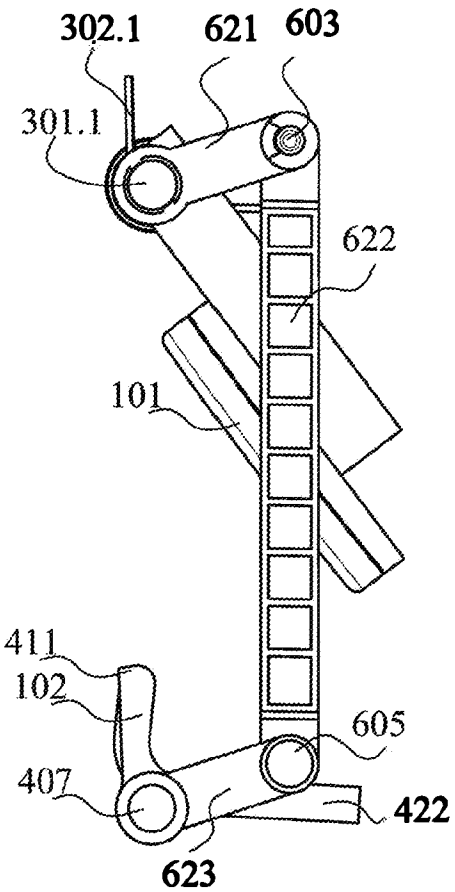
FIGS. 6B, 6C, and 6D are schematic views of an initial state, an intermediate state, and a final state of the cover plate, the connecting rod, and the operating component in FIG. 6A, respectively, during opening of the vehicle door.
Figure 6C:
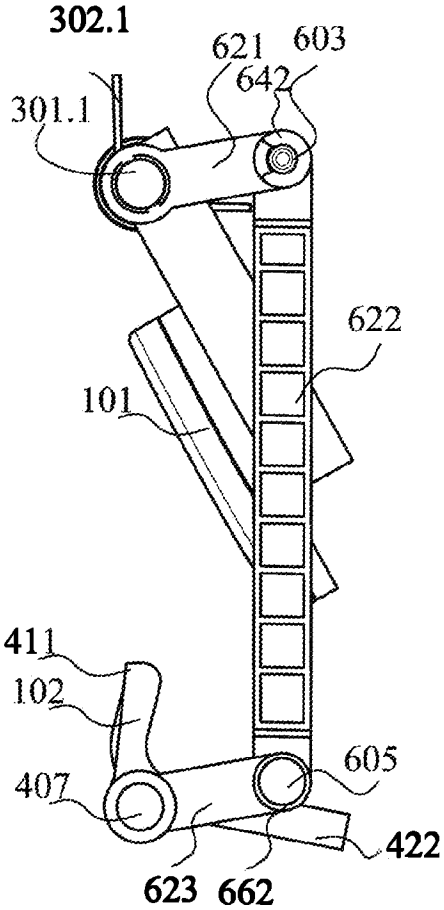
Figure 6B:
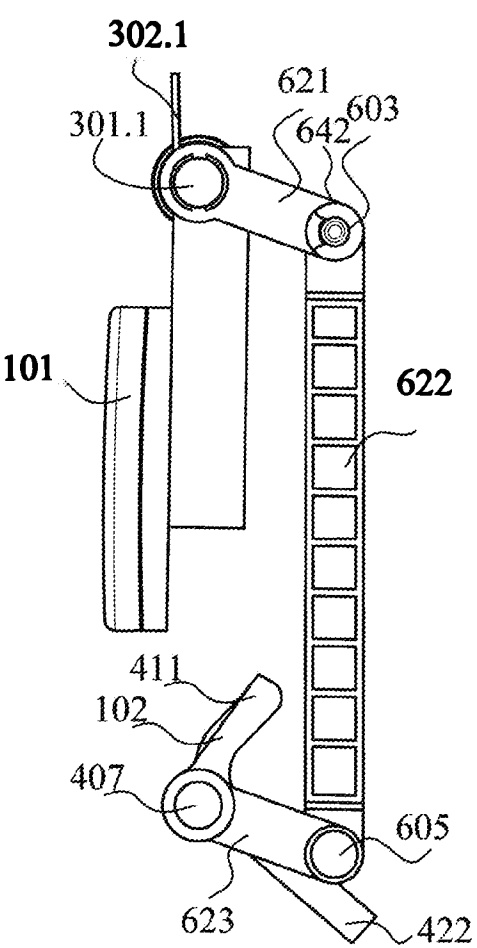

FIGS. 6B, 6C, and 6D respectively show an initial state, an intermediate state, and a final state of the cover plate, the connecting rod, and the operating component in FIG. 6A during the opening of the door, showing changes in the relative positions of the cover plate, the connecting rod, and the operating component in the process of opening the door. As shown in FIG. 6B, in the initial state, the cover plate 101 is held in an initial position by a force applied by the torsion spring 302.1, and the cover plate 101 is concealed in the sheet metal of the door. In this case, the actuator 422 of the operating component 102 is also at the lowest position.

FIG. 6C shows a state of the operation of opening the door. As shown in FIG. 6C, to open the door, an operator applies a thrust to the cover plate 101, and the thrust overcomes the force provided by the torsion spring 302.1, so that the cover plate 101 rotates around the first fixed rotational axle 301.1 toward the interior of the door. Due to the fixed connection between the first rod 621 and the cover plate 101, the first rod 621 and the cover plate 101 rotate together in a first direction (counterclockwise in the figure) about the first fixed rotational axle 301.1. When the first rod 621 rotates about the first fixed rotational axle 301.1, the first moving axle 603, driven by the second end 642 of the first rod 621, moves upward about the first fixed rotational axle 301.1 in a circumferential direction. When the first moving axle 603 moves upward in the circumferential direction about the first fixed rotational axle 301.1, the second rod 622 is driven to move upward. When the second rod 622 moves upward, the second moving axle 605 is driven to move upward. When the second moving axle 605 moves upward, the second end 662 of the third rod 623 moves upward, so that the third rod 623 rotates about the second fixed rotational axle 407. Since the third rod 623 is fixedly connected to the operating component 102, when the third rod 623 rotates about the second fixed rotational axle 407, the operating component 102 is driven by the third rod to rotate about the second fixed rotational axle 407 in a first direction (counterclockwise in the figure), causing the actuator 422 of the operating component 102 to move upward, thereby driving the rocker arm 103 (not shown) to rotate for opening the door lock so that the door can be opened. The rocker arm 103 will be described in detail below. During the movement of the connecting rod 109, both the first rod 621 and the second rod 622 can rotate relative to the first moving axle 603, and both the second rod 622 and the third rod 623 can rotate relative to the second moving axle 605.

FIG. 6D shows the final state of the operation of opening the door. When the cover plate 101 is pushed into the operating cavity 105, an operator can extend his/her hand into the operating cavity 105, thereby pulling the handle operating portion 411 of the operating component 102, and driving the operating component 102 to continue rotating about the second fixed rotation axle 407 in a first direction to the position as shown in FIG. 6D. In this case, the actuator 422 reaches a final position upward, thereby causing the rocker arm 103 to rotate to the final position, and the rocker arm 103 pulls the bolt out to open the door lock so that the door can be opened. The initial and final positions of the connecting rod are defined by the connecting rod limiter, as will be explained in the following description of FIG. 7.

It should be noted that, since the cover plate 101 and the operating component 102 are both connected to the connecting rod 109, when the cover plate 101 is rotated, the operating component 102 can be simultaneously rotated by the connecting rod 109; conversely, when the operating component 102 is rotated, the cover plate 101 can also be rotated by the connecting rod 109. In other words, the mechanism shown in FIGS. 6A to 6D provides at least two operation modes for opening the door lock. In one mode, an operator pushes the cover plate 101 so that his/her hand can be extended into the operating cavity 105, and then pulls the operating component 102, thereby causing the rocker arm 103 to open the door lock. In the other mode, an operator pushes the cover plate 101 so that his/her hand can be extended into the operating cavity 105, then continues pushing the cover plate 101 to the final position, while the operating component 102 continues rotating as the cover plate 101 continues rotating, thereby driving the rocker arm 103 to open the door lock. In other words, the process of opening the door lock is completed by the operating component 102 driving the rocker arm 103 to the final position, and the process of opening the door lock can be realized by rotating the operating component 102 via the cover plate 101 or by directly pulling the operating component 102. When the door lock is opened, the operator can open the door by pulling the door.

Figure 7:
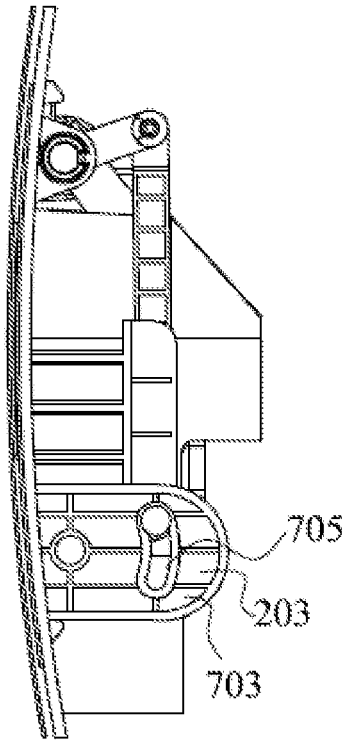
FIG. 7 is a cross-sectional view taken along line A-A shown in FIG. 1B.

FIG. 7 is a cross-sectional view taken along line A-A shown in FIG. 1B for illustrating the specific structure of the connecting rod limiter 203. As shown in FIG. 7, the connecting rod limiter 203 comprises a limiting plate 703, the limiting plate 703 is fixed on the housing 107, and the limiting plate 703 is provided with a limiting slot 705. The limiting slot 705 is curved, and the second moving axle 605 can be inserted into the limiting slot 705 and moved along the trajectory of the limiting slot 705. The lowest position of the limiting slot 705 limits the farthest distance by which the second moving axle 605 moves downward, and the downward movement of the second moving axle 605 causes the second rod 622 to move downward to drive the first rod 621 and the cover plate 101 to rotate against a first direction. In other words, the lowest position of the limiting slot 705 limits the final position of the cover plate 101 in the process of resetting, which means that the cover plate 101 exactly covers the position of the operating cavity 105. The cover plate 101 exactly covers the position of the operating cavity 105, that is, the initial position of the cover plate 101 when it is not subjected to a thrust applied by an operator. The limiter 203 and the cover plate resetter can cooperate to hold the cover plate in the initial position. The highest position of the limiting slot 705 limits the farthest distance by which the second moving axle 605 moves upward, and the upward movement of the second moving axle 605 causes the second rod 622 to move upward, thereby driving the first rod 621 and the cover plate 101 to rotate in a first direction. In other words, the highest position of the limiting slot 705 limits the final position that the cover plate 101 can reach when being subjected to an external force.

Figure 8A:
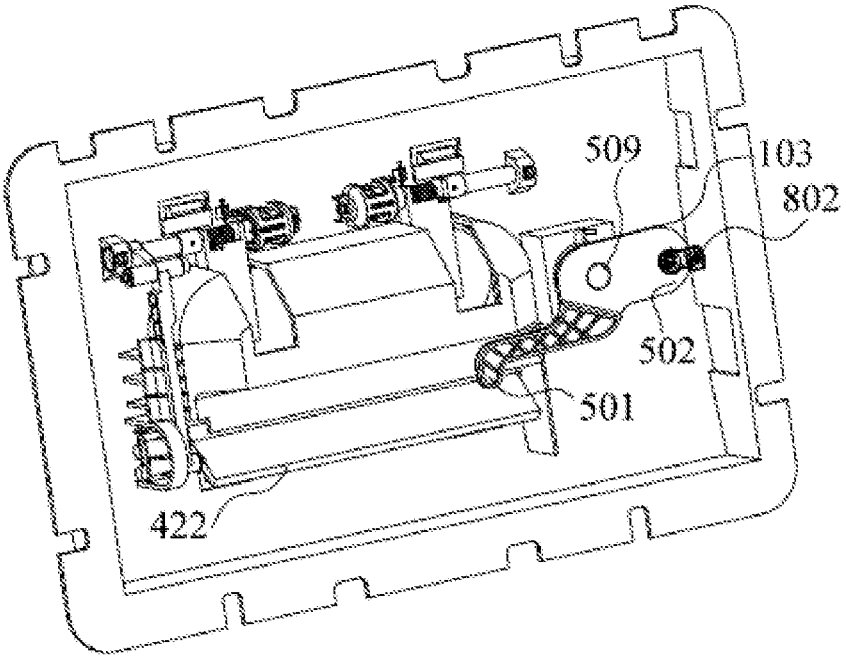
FIGS. 8A, 8B, and 8C are schematic views of the rear side of the mechanism for opening a vehicle door according to the present invention, respectively showing the fitting relationship between the operating component and the rocker arm in an initial state, an intermediate state, and a final state during the opening of the vehicle door.
Figure 8B:
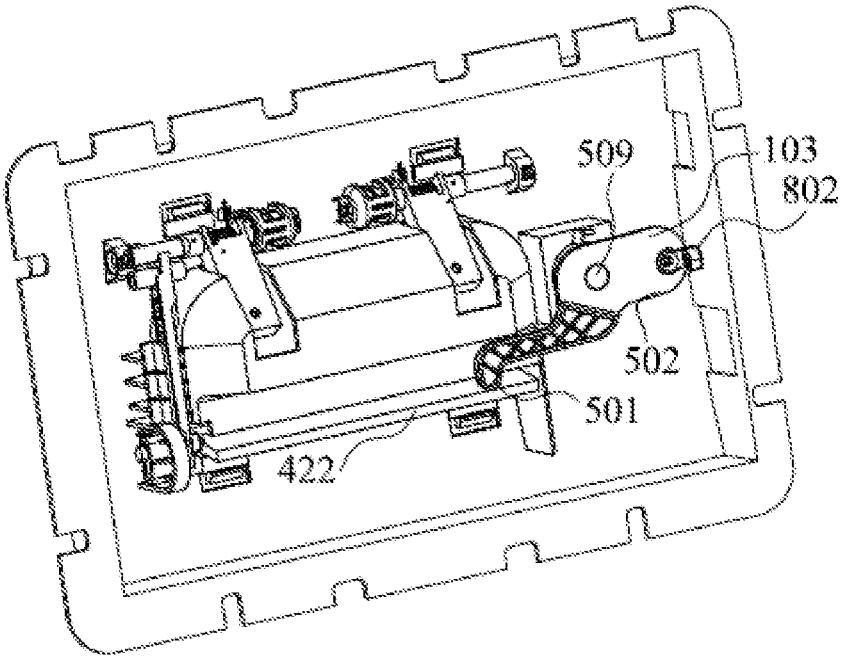
Figure 8C:
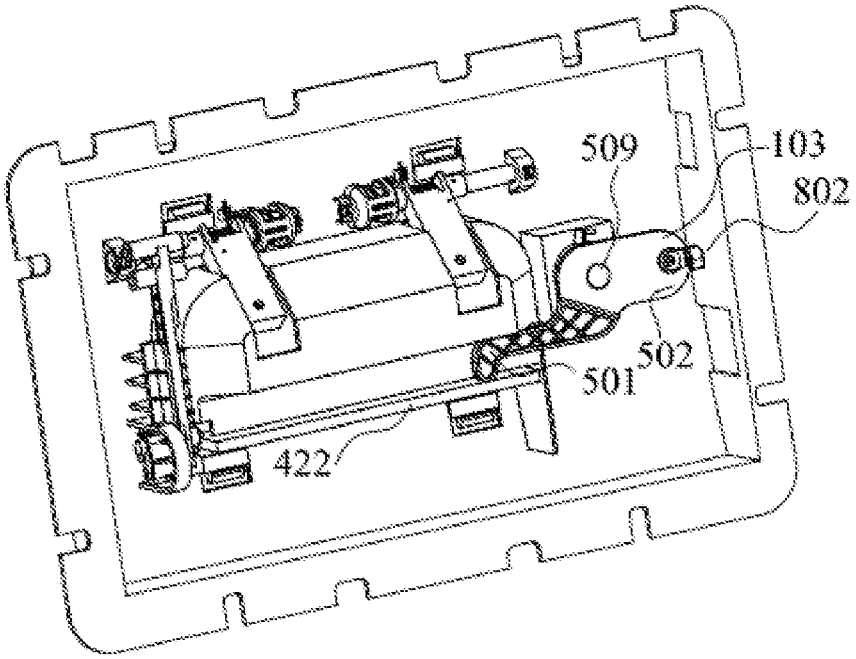

FIGS. 8A, 8B, and 8C are schematic views of the rear side of the mechanism 100 for opening a vehicle door according to the present invention, respectively showing the fitting relationship between the operating component and the rocker arm in the initial state, the intermediate state, and the final state during the opening of the door. The state of the operating component in FIG. 8A corresponds to FIG. 6B, the state of the operating component in FIG. 8B corresponds to FIG. 6C, and the state of the operating component in FIG. 8C corresponds to FIG. 6D. As shown in FIGS. 8A to 8C, as described above, the rocker arm 103 is mounted on the housing 107 and is rotatable about the third fixed rotational axle 509, and both ends of the rocker arm 103 are the actuated portion 501 and the execution portion 502, respectively. The actuated portion 501 abuts against the actuator 422, and the execution portion 502 is provided with a connection assembly 802 for connection with a bolt (not shown); when the bolt is pulled out, the vehicle door is opened. As described above, a rocker arm resetter is provided between the rocker arm 103 and the housing 107 to hold the actuated portion of the rocker arm 103 against the actuator 422, so that the rocker arm 103 is reset when the operating component 102 is reset.

In the initial state shown in FIG. 8A, the actuator 422 of the operating component 102 is at the lowest position, and the actuated portion 501 is also at the lowest position. As shown in FIG. 8B, when the operator applies a force to the cover plate 101 or the operating component 102, the operating component 102 rotates and the actuator 422 moves upward, enabling the actuated portion 501 to also move upward, so that the rocker arm 103 rotates about the third fixed rotational axle 509, driving the execution portion 502 to move downward. As shown in FIG. 8C, when the operator further applies force to the cover plate 101 or the operating component 102 to bring the operating component 102 to the final position, the actuator 422 moves further upward, enabling the actuated portion 501 to also move further upward so that the rocker arm 103 continues rotating about the third fixed rotational axle 509, driving the execution portion 502 to move further downward; finally, the door lock is opened by pulling out the bolt connected to the connection assembly 802, so that the door can be opened.

Figure 9C:
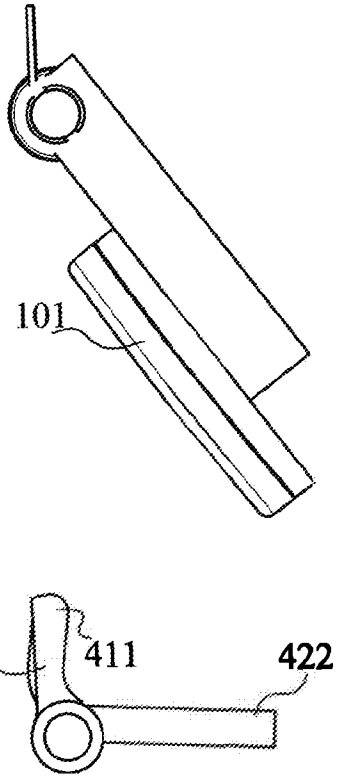
FIGS. 9A, 9B, and 9C are schematic views of an initial state, an intermediate state, and a final state of a cover plate and an operating component in the process of opening a door in another embodiment of the present invention.
Figure 9B:
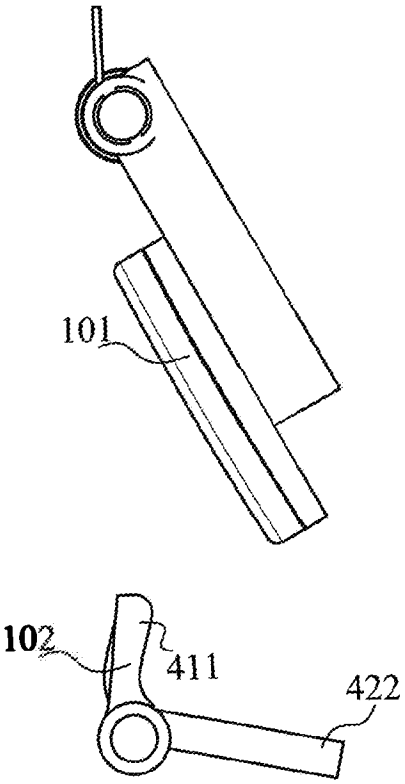
Figure 9A:
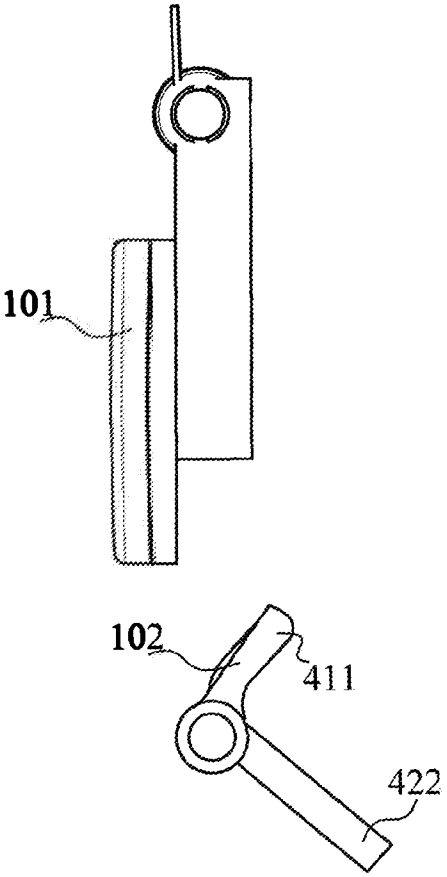

FIGS. 9A, 9B, and 9C are schematic diagrams showing an initial state, an intermediate state, and a final state of a cover plate and an operating component in the process of opening a vehicle door in another embodiment according to the present invention. The embodiment shown in FIGS. 9A to 9C is similar to the embodiment shown in FIGS. 6A to 6C, except that in the embodiment shown in FIGS. 9A to 9C, no connecting rods are provided between the cover plate 101 and the operating component 102; thus, the cover plate 101 and the operating component 102 are rotated independent of each other. The position of the cover plate 101 and that of the operating component 102 with no external force applied are shown in FIG. 9A. When the door needs to be opened, an operator applies a thrust to the cover plate 101 until it reaches the position shown in FIG. 9B. In this case, the operator can extend his/her hand into the cavity to rotate the operating component 102 until the operating component 102 reaches the final position shown in FIG. 9C, driving the rocker arm 103 to pull out the bolt for opening the door lock. In the present embodiment, the cover plate 101 and the operating component 102 do not rotate at the same time, and the action performed by the operator to push the cover plate 101 is solely to enable his/her hand to enter a space in which the operating component 102 can be operated. In the present embodiment, an operating component resetter is provided between the operating component 102 and the housing 107 so that the operating component can be returned to the initial position shown in FIG. 9A after the door lock is opened.

While certain features of the present invention have been particularly described above with reference to drawings and preferred embodiments, it should be understood that those of ordinary skill in the art can make various substitutions and improvements without departing from the spirit and scope of the present invention as defined by the attached claims.

The invention claimed is:

1. A mechanism for opening a vehicle door, comprising:

an operating component including an actuator, the operating component being disposed in an operating cavity adjacent to a first side of the operating cavity;

a cover plate arranged along an opening of the operating cavity; and a transmission mechanism arranged in the operating cavity, wherein a side edge of the cover plate is mounted on a first fixed rotational axle arranged adjacent to a second side of the operating cavity, opposite the first side, such that the cover plate is rotatable between a first position, in which an exterior surface of the cover plate is aligned with an exterior surface of the vehicle door, and a second position, in which the cover plate is within the operating cavity, wherein the operating component is rotatably mounted on a second fixed rotational axle arranged adjacent to the first side of the operating cavity such that second fixed rotational axle is disposed at a distance from the first fixed rotational axle, wherein the transmission mechanism is mounted on the first fixed rotational axle and the second fixed rotational axle, the transmission mechanism being configured to be driven by rotation of the cover plate between the first and second positions, and wherein, when an external force is applied to the exterior surface of the cover plate in the first position, the cover plate rotates about the first fixed rotational axle from the first position to the second position such that the operating component is actuated and accessible to an operator via the operating cavity to open the vehicle door.

2. The mechanism of claim 1, wherein, when the cover plate rotates along the first fixed rotational axle from the first position to the second position, with the cover plate being at least at a predetermined angle relative to the first position, the cover plate drives the transmission mechanism such that the transmission mechanism causes the actuator to rotate from a first actuator position to a second actuator position, in which the actuator actuates the operating component for opening the vehicle door.

3. The mechanism of claim 2, wherein the transmission mechanism includes a connecting rod, the connecting rod including a first rod connected to the cover plate and that is rotatable along the first fixed rotational axle, a second rod connected to the first rod by a first moving axle, and a third rod that is connected to the second rod by a second moving axle and that is rotatable along the second fixed rotational axle, and wherein the actuator is connected to the third rod such that the transmission mechanism causes the actuator to rotate to the second actuator position and actuate the operating component for opening the vehicle door.

4. The mechanism of claim 3 further comprising:

a connecting rod limiter configured to limit a range of movement of the second moving axle.

5. The mechanism of claim 4, wherein the connecting rod limiter includes a limiting plate that defines a limiting slot, and wherein the second moving axle is inserted into the limiting slot.

6. The mechanism of claim 1, wherein the operating component further includes a handle operating portion connected to the actuator, wherein the operating component is actuated when the actuator is rotated from a first actuator position to a second actuator position, and wherein when an operator applies a force to the handle operating portion, the operating component rotates from a first position, in which the actuator is in the second actuator position, to a second position, in which the actuator rotates to a third actuator position and causes a vehicle door lock of the vehicle door to be opened.

7. The mechanism of claim 6, wherein the operating component is an L-shaped plate including a first plate and a second plate connected to the first plate, the first plate including the handle operating portion, and the second plate including the actuator, and wherein the second fixed rotational axle is mounted at a junction of the first plate and the second plate such that the L-shaped plate is rotatable about the second fixed rotational axle.

8. The mechanism of claim 7 further comprising:

a rocker arm rotatably mounted on a third fixed rotational axle, the rocker arm having an actuated portion and an execution portion, wherein, when the actuator rotates to the third actuator position, the actuator drives the actuated portion of the rocker arm and the rocker arm rotates along the third fixed rotational axle such that the execution portion of the rocker arm opens the vehicle door lock.

9. The mechanism of claim 8, wherein the third fixed rotational axle is arranged adjacent to a third side of the operating cavity that is adjacent to the first and second sides of the operating cavity.

10. The mechanism of claim 1, wherein the first fixed rotational axle includes first and second sections connected to the side edge of the cover plate and that are coaxially aligned.

11. The mechanism of claim 1 further comprising:

a cover plate resetter configured to bias the cover plate toward the first position.

12. A mechanism for opening a vehicle door, comprising:

a vehicle door opening means, the vehicle door opening means being disposed in an operating cavity;

a cover plate covering an opening of the operating cavity such that an exterior surface of the cover plate is aligned with an exterior surface of the door; and a first fixed rotational axle mounted within the operating cavity, a side edge of the cover plate being mounted on the first fixed rotational axle such that when an external force is applied to the cover plate, the cover plate is rotatable along the first fixed rotational axle to enter into the operating cavity such that an operator hand can extend into the operating cavity to operate the vehicle door opening means, wherein the vehicle door opening means includes:

an operating component rotatably mounted on a second fixed rotational axle, the operating component including an actuator; and a rocker arm rotatably mounted on a third fixed rotational axle, the rocker arm having an actuated portion and an execution portion, and wherein rotation of the actuator of the operating component drives the actuated portion of the rocker arm to cause the rocker arm to rotate about the third fixed rotational axle such that the execution portion of the rocker arm opens a vehicle door lock.

13. The mechanism for opening a vehicle door of claim 12 further comprising:

a transmission mechanism disposed in the operating cavity, the transmission mechanism being driven by rotation of the cover plate and being configured to drive the actuator of the operating component, wherein when the cover plate rotates toward an interior of the operating cavity along the first fixed rotational axle by more than a predetermined angle, the cover plate drives the transmission mechanism such that the transmission mechanism drives the actuator of the operating component.

14. The mechanism for opening a vehicle door of claim 13, wherein the transmission mechanism includes a connecting rod, the connecting rod including a first rod connected to the cover plate and rotatable about the first fixed rotational axle, a second rod connected to the first rod by a first moving axle, and a third rod, the second and third rods being connected by a second moving axle, and wherein the third rod is connected to the actuator of the operating component such that the transmission mechanism causes the actuator to rotate.

15. The mechanism for opening a vehicle door of claim 14 further comprising:

a connecting rod limiter configured to limit a range of movement of the second moving axle.

16. The mechanism for opening a vehicle door of claim 12, wherein the operating component further includes a handle operating portion, and wherein, when an operator applies a force to the handle operating portion, the operating component is rotatable such that the actuator drives the rocker arm to rotate.

17. The mechanism for opening a vehicle door of claim 16, wherein the operating component is an L-shaped plate including a first plate and a second plate connected to the first plate, the first plate including the handle operating portion, the second plate including the actuator, and wherein the second fixed rotational axle is mounted at a junction of the first plate and the second plate such that the L-shaped plate is rotatable along the second fixed rotational axle.

18. The mechanism for opening a vehicle door of claim 12, wherein the third fixed rotational axle extends in a direction perpendicular to the extending direction of the second fixed rotational axle.

19. The mechanism for opening a vehicle door of claim 12 further comprising:

a cover plate resetter configured to bias the cover plate toward the exterior surface of the vehicle door.

20. A mechanism for opening a vehicle door, comprising:

a cover plate covering an opening of an operating cavity such that an exterior surface of the cover plate is aligned with an exterior surface of the door;

a first fixed rotational axle mounted within the operating cavity, a side edge of the cover plate being mounted on the first fixed rotational axle such that when an external force is applied to the cover plate, the cover plate is rotatable along the first fixed rotational axle to enter into the operating cavity;

an operating component rotatably mounted on a second fixed rotational axle, the operating component including an actuator and is configured to rotate by a force directly applied to the operating component by a user or by the external force applied to rotate the cover plate; and a rocker arm rotatably mounted on a third fixed rotational axle, the rocker arm including an actuated portion and an execution portion, wherein rotation of the actuator of the operating component drives the actuated portion of the rocker arm to cause the rocker arm to rotate along the third fixed rotational axle such that the execution portion of the rocker arm opens a vehicle door lock.

* * * * *